US009984559B2

(12) United States Patent
Naylor et al.

(10) Patent No.: US 9,984,559 B2
(45) Date of Patent: May 29, 2018

(54) INTRUSION DETECTION WITH MOTION SENSING

(71) Applicant: VSK Electronics NV, Harelbeke (BE)

(72) Inventors: Matthew Naylor, Myrtle Bank (AU); Gerdy Maelbrancke, Harelbeke (BE); Thomas Goulet, Harelbeke (BE); Jörg Tilkin, Harelbeke (BE); Philippe Cornez, Harelbeke (BE); Federico Montagni, Harelbeke (BE)

(73) Assignee: VSK Electronics NV, Harelbeke (BE)

( * ) Notice: Subject to any disclaimer, the term of this patent is extended or adjusted under 35 U.S.C. 154(b) by 0 days. days.

(21) Appl. No.: 15/123,505

(22) PCT Filed: Mar. 3, 2015

(86) PCT No.: PCT/EP2015/054446

§ 371 (c)(1),
(2) Date: Sep. 2, 2016

(87) PCT Pub. No.: WO2015/132272

PCT Pub. Date: Sep. 11, 2015

(65) Prior Publication Data

US 2017/0076588 A1 Mar. 16, 2017

Related U.S. Application Data

(60) Provisional application No. 61/947,329, filed on Mar. 3, 2014.

(51) Int. Cl.

| | |
|---|---|
| ***G08B 29/18*** | (2006.01) |
| ***G08B 13/19*** | (2006.01) |
| ***G08B 13/196*** | (2006.01) |

(52) U.S. Cl.

CPC ..... *G08B 29/188* (2013.01); *G08B 13/19* (2013.01); *G08B 13/19608* (2013.01); *G08B 13/19671* (2013.01); *G08B 29/185* (2013.01)

(58) Field of Classification Search

CPC ..... G08B 13/19; G08B 13/19608; G08B 13/19671; G08B 29/185; G08B 29/188

(Continued)

(56) References Cited

U.S. PATENT DOCUMENTS 4,710,750 A 12/1987 Johnson
4,857,912 A 8/1989 Everett, Jr. et al.

(Continued)

FOREIGN PATENT DOCUMENTS

WO WO-2015132272 9/2015

OTHER PUBLICATIONS

"International Application No. PCT/EP2015/054446, International Search Report and Written Opinion dated May 8, 2015", (May 8, 2015), 20 pgs.

*Primary Examiner* — Nader Bolourchi

(74) *Attorney, Agent, or Firm* — Schwegman Lundberg & Woessner, P.A.

(57) ABSTRACT

An intrusion detection system comprises at least two detectors. Each detector is configured to produce a detection output. At least one information module is configured to produce metadata that relates to the performance of one or more of the at least two detectors. An analysis module is configured to produce a combined alarm signal. The combined alarm signal is a function of the plurality of detection outputs from the at least two detectors and the metadata. The metadata may include information relating to adverse conditions that reduce detection performance of one or more of the detectors. The at least two detectors preferably include at least one video motion detector and a passive infrared detector.

25 Claims, 2 Drawing Sheets

(58) Field of Classification Search
USPC ..... 340/557
See application file for complete search history.

(56) References Cited

U.S. PATENT DOCUMENTS 5,493,273 A * 2/1996 Smurlo ..... G08B 29/16
340/309.16
5,936,666 A 8/1999 Davis
6,508,397 B1 * 1/2003 Do ..... G07F 19/207
235/379

* cited by examiner

INTRUSION DETECTION WITH MOTION SENSING

PRIORITY CLAIM TO RELATED APPLICATIONS

This application is a U.S. national stage application filed under 35 U.S.C. § 371 from International Application Serial No. PCT/EP2015/054446, which was filed 3 Mar. 2015, and published as WO2015/132272 on 11 Sep. 2015, and which claims priority to U.S. Provisional Application Ser. No. 61/947,329, filed 3 Mar. 2014, which applications and publication are incorporated by reference as if reproduced herein and made a part hereof in their entirety, and the benefit of priority of each of which is claimed herein.

FIELD OF THE INVENTION

The present invention generally relates to security systems. More specifically, the invention relates to systems of detection employing more than one method of sensing such as video capture and infra-red sensing.

BACKGROUND OF THE INVENTION

There are many different technologies suitable for detecting intruders entering a site. Two technologies that are regularly used in the current security industry are passive infra-red (PIR) detection, and video motion detection (VMD).

Detectors including PIR sensors measure the intensity of heat at wavelengths that match those of the heat emitted by warm blooded animals including humans. If this heat intensity differs from the background heat intensity, then the detector can detect the change as the animal passes in front of the sensor, and raise an alarm. If two PIR sensors are used in tandem, a differential signal may be produced and detected as the target crosses first one and then the other sensor. This increases the signal reliability and compensates for ambient temperature changes.

PIR detectors target all objects that have a different temperature to the background temperature and cross into a detection area (field of view) or a virtual curtain. Because a hot target at a distance can give a similar signature to a cooler target nearby, the maximum range of a PIR is unbounded, and sometimes needs to be "terminated" using a physical barrier just beyond the maximum desired detection distance. Conversely, PIR detectors are insensitive to targets that have a similar temperature to the background, such as a person wearing a wet coat on a wet day. Furthermore, since the detection pattern is fixed by the selected optics, it is not configurable and may not be optimal for a particular intrusion event.

VMD is performed by computer software on a sequence of digital images captured by a video camera that is monitoring the scene of interest. Each image in the sequence is composed of an array of picture elements (pixels). Targets such as intruders typically show up as a different intensity to the background scene in the image and VMD detects intruders in the sequence by looking for changes in pixel intensities that are consistent with a target moving through the scene. Groups of pixels associated with a target are tracked from frame to frame to determine the direction of motion. If the scene is calibrated, the size of the target, the distance it has travelled, and the speed of its travel can be estimated from the tracked group of pixels. By ignoring targets that do not meet size, speed, distance travelled and direction criteria, the security system can be tuned to detect human and vehicle movement while rejecting small animal and foliage movement. However, while many targets can be filtered out by these methods and ignored, some cannot. VMD is sensitive to all changes of intensity in the scene so it can potentially detect moving shadows, moving headlights and/or the beams of light they project onto the scene, moving foliage, animals, birds, humans, and vehicles. Those changes that are not caused by humans or vehicles can create false alarms that consume time and money for monitoring stations responsible for the security of the premises. Conversely, if the target cannot be clearly seen due to poor contrast between target and background, due to poor lighting or inclement weather for example, then VMD may fail to detect it. Neither outcome is desirable for a security system.

In order to improve detection performance and reliability combined PIR and VMD detection systems have been employed. To reduce the occurrence of false alarms from either technology, it is common practise to perform a logical AND operation on the VMD and PIR outputs to produce an alarm only if both detection methods go into alarm. This is called a "double-knock" system.

If VMD and PIR detectors are used together in a double-knock arrangement, the combined system has better false alarm rejection (it ignores false alarms that affect only one type of detector), but a reduced detection capability (it may not detect targets that a system with one type of detector could detect). It is also still possible to produce false alarms if both detectors detect different false alarms simultaneously. A further problem is that the fields of view of the PIR detector and the VMD may not be identical which also reduces the validity of the double knock configuration. An alternative configuration is to accept all alarms from both detectors (logical OR operation). This increases the detection capability as all detections cause alarms, but also increases the false alarm rate as false detections from either detector cause alarms.

The problem across all these permutations is poor detection system performance either through too many false alarms or too many missed detections. The present invention aims to provide a detection system with improved detection performance and fewer false alarms.

Reference to any prior art in the specification is not an acknowledgment or suggestion that this prior art forms part of the common general knowledge in any jurisdiction or that this prior art could reasonably be expected to be understood, regarded as relevant, and/or combined with other pieces of prior art by a skilled person in the art.

SUMMARY OF THE INVENTION

In a first aspect of the invention, there is provided an intrusion detection system. The system includes: at least two detectors, wherein each detector is configured to produce a detection output; at least one information module configured to produce metadata that relates to the performance of one or more of the at least two detectors; and an analysis module. The analysis module is configured to produce a combined alarm signal, wherein the combined alarm signal is a function of the plurality of detection outputs from the at least two detectors and the metadata. The detection output from a detector can be a detector-derived alarm signal, raw or processed sensor signal, or other output from which a detection event may be determined. One or more of the information modules may be located within one or more of the detectors. The detection output may only be produced when the respective detector detects an intrusion event.

In one embodiment, the at least one information module is configured to output metadata to the analysis module. The metadata can, for example relate to adverse conditions that reduce detection performance of at least one of the detectors. The analysis module is configured to receive the metadata and determine the combined alarm signal. In a most preferable embodiment, the function is chosen to favour an output from one or more detectors whose performance is least affected by an adverse condition.

In some embodiments, the function is a weighted sum of detection outputs from the at least two detectors. The weighted sum can depend on weighting factors corresponding to each of the at least two detectors. The weighting factors can depend on the metadata. In one embodiment, the weighted sum is a linear sum of detector outputs weighted by the weighting factors. The metadata can be received by the analysis module to determine the weighting factors. Alternatively, the metadata can be received by the detectors which apply the weighting factors to the detection outputs to produce weighted detection outputs, the analysis module then receives the weighted detection outputs and determines a combined alarm signal.

In an alternative embodiment, the function is embodied as a table of combined alarm signal values indexed by at least one vector corresponding to outputs from at least two detectors and comprising values from a first plurality of possible values of the detector outputs and at least one value corresponding to the metadata. In a preferred embodiment a smaller vector is computed having at least one combined value corresponding a combination of one or more outputs and/or at least one value corresponding to the metadata to index a smaller table of alarm signal values. In a most preferred embodiment, the smaller vector may be computed by grouping components of the vector. In a most preferred embodiment, at least one of the detectors is a video motion detector (VMD) and at least one of the detectors is a passive infra-red (PIR) detector.

The adverse conditions include, but are not limited to, poor lighting, fog, smoke, moving shadows, or a physical obscuration on or near the at least one detector such as insects, spiders, dirt or plant foliage.

In a second aspect of the invention, there is provided an intrusion detection system. The system includes at least two detectors wherein each detector is configured to produce detection outputs. One detector is a PIR detector, wherein the PIR detector includes at least two PIR sensors. The system is configured such that each of the at least two PIR sensors must detect a target in order for the PIR detector to output a PIR alarm signal. The system is further configured such that a PIR alarm signal is output if adverse conditions that affect PIR detection performance are detected and any one of the at least two PIR sensors detects a target. The adverse conditions may include fog or heavy rain for example.

In a preferred embodiment, at least one of the detectors is a VMD that has a field of view that at least partially overlaps the fields of view of the PIR sensors. The VMD is configured to detect the adverse conditions. Advantageously, the VMD is configured to output metadata relating to adverse conditions when adverse conditions that affect PIR detection performance are detected. The output metadata from the VMD is received and processed by an analysis module. The analysis module is further configured to send a control signal to the PIR detector when adverse conditions are detected by the VMD. The PIR detector is configured to receive the control signal and, when the control signal is received from the analysis module, output a PIR alarm signal if any one of the at least two PIR sensors detects a target.

In an embodiment, the analysis module is configured to receive alarm signals from the PIR and VMD detectors and output a combined alarm signal wherein the combined alarm signal is a function of signals according to the first aspect of the invention.

In an alternate embodiment, the VMD is configured to detect if there has been a VMD tampering event. If a tampering event occurs the VMD metadata includes an indication of tampering. The analysis module is configured to send the control signal to the PIR detector when a VMD tampering event occurs so that the PIR detector is configured to require each of the at least two PIR sensors to detect the intrusion event when the control signal is received from the analysis module.

In another embodiment, time of day is accounted for by the analysis module when the VMD metadata indicates that there are adverse conditions including reduction or loss of light. For example, if the time of day falls within twilight or sunset the control signal is not sent.

In another embodiment, the at least two PIR sensors form corresponding pairs, at least one sensor from each pair includes at least one emitter producing emissions that can be detected by the opposing PIR sensor or another suitable receiver. The system is configured such that a reduced intensity or non-detection of emissions by the corresponding receiver is taken to be an adverse condition. In a preferred embodiment, the emissions are electro-magnetic radiation. In a most preferred embodiment, the emitter is a light-emitting diode (LED). In an optional embodiment, the emissions are time or frequency modulated.

In a third aspect of the invention, there is provided an intrusion detection system. The system includes at least one Video Motion Detector (VMD) and at least one Passive Infrared PIR detector, each detector being configured to output an alarm signal to an analysis module when the respective detector detects an intrusion event. The at least one PIR detector is used to determine a parameter of an intruding target and the at least one VMD independently determines the parameter of at least one target in a field of view of the VMD. If the parameter determined by the PIR substantially matches the parameter of the at least one target tracked by the VMD then the analysis module is configured to send a control signal to the VMD and/or PIR detector, such that the VMD and/or PIR detector sensitivity is increased when a control signal from the analysis module is received.

If the parameter determined by the PIR substantially matches the parameter of the at least one target tracked by the VMD then the analysis module may also be configured to produce an alarm signal.

The alarm signal may be a combined alarm signal wherein the combined alarm signal is a function of signals according to the first aspect of the invention.

In preferred embodiments, the parameter includes any one or more of the parameters selected from the group of position, speed, size or direction. In a preferred embodiment, the position is a range zone within a field of view of the at least one PIR detector. In another preferred embodiment, the size of the intruding target determined by the at least one VMD detector is related to the amplitude of the PIR signal.

In another embodiment, the analysis module is configured to send a control signal to the PIR detector to increase a PIR detection sensitivity when a strong VMD signal is received by the analysis module. If the intrusion event is detected by the PIR detector then the analysis module produces an alarm signal.

In an alternative embodiment, the analysis module is configured to send a control signal to the VMD to increase VMD detection sensitivity when a strong PIR detection signal is received by the analysis module. If the intrusion event is detected by the VMD then the analysis module produces an alarm signal. In a preferred embodiment, the VMD sensitivity is only increased in locations corresponding to locations where the strong PIR detection signal is received.

In some embodiments, the PIR detector signal is an uncompensated signal, wherein the uncompensated signal is not temperature compensated at the PIR detector so that alarm conditions can be determined remotely from the sensor. The ambient temperature may be determined independently of the PIR signal and used in conjunction with the uncompensated PIR signal to determine the PIR alarm conditions.

In another embodiment, the system includes a motorized uniaxial mount that the VMD is mounted to. The mount and VMD are configured to use the PIR alarm signal to direct the VMD to turn and zoom to adjust the field of view to focus on the position of the target determined by the PIR detector. The VMD is configured to analyse the data from the new field of view.

In a further aspect of the invention, a method of detecting intruders is provided that includes using an intrusion detection system in accordance with the first, second or third aspects of the invention. In a preferred form the method includes issuing an alarm or alert output if an intruder is detected.

As used herein, except where the context requires otherwise, the term "comprise" and variations of the term, such as "comprising", "comprises" and "comprised", are not intended to exclude further additives, components, integers or steps.

Further aspects of the present invention and further embodiments of the aspects described in the preceding paragraphs will become apparent from the following description, given by way of example and with reference to the accompanying drawings.

BRIEF DESCRIPTION OF THE DRAWINGS

The invention will now be described, by way of example only, with reference to the accompanying drawings in which.

DETAILED DESCRIPTION OF THE EMBODIMENTS

The preferred embodiments take advantage of additional data that is computed in the determination of an alarm signal in a detection system such as a VMD system, and PIR system. By combining those lower level additional data features from multiple sensor types a rich data is available from which to make better alarm decisions. The following embodiments describe systems that make use of at least one additional piece of information with the output of a VMD and a PIR detector to improve the detection performance of a security system. In some embodiments, the information could be determined from the output of the VMD or PIR detectors, such as the level of noise, the scene brightness or the scene contrast; or it could be information about a target that the detector has detected or is considering, such as its speed, size or distance from the sensor.

Alternatively, or additionally the information can be determined from an additional sensor associated with one or both of the VMD or PIR detectors.

Figure 1:
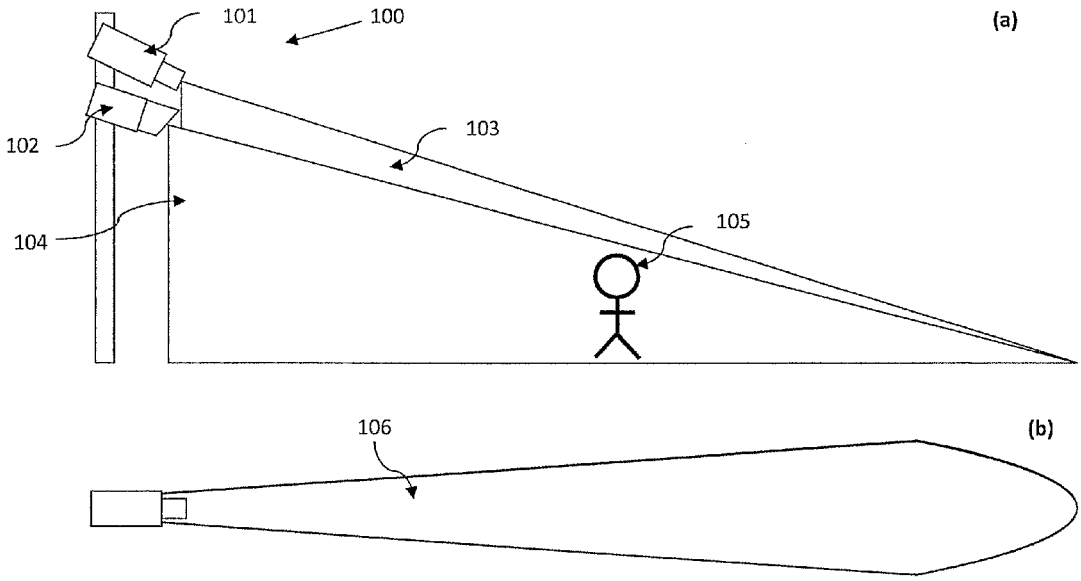
FIG. 1*a* shows a side view of an intrusion detection system.
FIG. 1*b* shows a combined field of view the intrusion detection system of FIG. 1*a*, shown from above.

A security system is described that includes an intrusion detection system 100 that includes two detectors. FIG. 1 shows a side view of system 100. In the description that follows, one detector is a video motion detector (VMD) 101, and the other is a passive infra-red (PIR) detector 102. It will be appreciated that other types of detectors may instead be employed without departing from the scope of the invention.

The VMD 101 includes a camera with a field of view 103 and the PIR detector 102 has a field of view 104. The field of view is understood to define a volume of space. If an intruder 105 enters the defined volume, i.e. the field of view 103 or 104, the intruder 105 can be detected as a target by the respective detector 101 or 102.

The system has a combined field of view 106 where at least one detector 101, 102 can detect an intruding target 105. An example of the shape of the combined field of view as viewed from above is shown in FIG. 1*b*. The fields of view of the detectors overlap, however, they may not cover the same volume. If the field of view of a detector covers volume not covered by the other detector then the combined field of view 106 is considered to be total volume of space where an intruder 105 can be detected by at least one detector.

Figure 2:
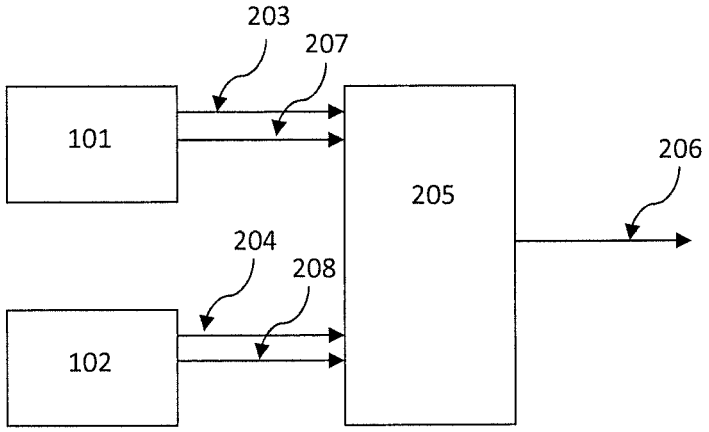
FIG. 2 shows a block diagram of an intrusion detection system according to an embodiment of the invention.

If the intruder 105 is in the combined field of view 106 then it may be detected as a target by both the detectors 101, 102. As shown in FIG. 2, VMD 101 generates a detection output signal 203. This may be in the form of an alarm signal 203 that is produced when the VMD detects a target 105. The PIR detector 102 also generates a detection output 204 which may be an alarm signal 204 that is produced when the PIR detector detects a target 105. In this embodiment of the invention, VMD 101 also includes an information module that produces metadata 207 and the PIR detector includes an information module that produces metadata 208. Broadly speaking, metadata 207, 208 takes the form of information relating to conditions that affect the reliability of alarm signals from at least one of the detectors 101, 102. For example, the visual conditions may be poor and lead to false or detection or missed detection. The metadata 207, 208 may include, but is not limited to, a measure of confidence in the alarm signal which, for example, indicates the likelihood of correct detection of an intruder 105. A false detection of an intruder 105 may be the result of the target of a detector 101, 102 being due to movement of foliage or localised changes in the background temperature in the combined field of view.

Detection output signals 203, 204 and metadata 207, 208 are sent to an analysis module 205 (see FIG. 2). The analysis module 205 processes alarm signals 203, 204 and metadata 207, 208 and generates a combined alarm signal, S, 206. The combined alarm signal 206 is a function, $f$, of the signal from the VMD, $S_V$, 203 and the signal from the PIR detector, $S_{IR}$, 204:

$$S=f(S_V,S_{IR})$$

In a one embodiment, $f$ is a weighted linear sum of the alarm signal from the VMD, $S_V$, 203 and the alarm signal from the PIR detector, $S_{IR}$, 204:

$$S=\omega_V.S_V+\omega_{IR}.S_{IR}$$

where $\omega_V$ and $\omega_{IR}$ are weighting factors for the VMD alarm signal and PIR alarm signals respectively. $f$ may be another mathematical function that combines the two signals and at least one piece of metadata, including but not limited to a polynomial, logarithmic or exponential function. In other embodiments, S may be determined using a function that applies fuzzy logic.

In other embodiments the function may not be a mathematical function, for example the function may comprise a one or more heuristic rules or a 'look-up table'. The look-up table may be, for example, a table of system output values indexed by a vector comprising each detector's output and at least one item of metadata. In a preferred embodiment the table may be reduced in size or dimension by computing a smaller vector from computed the detector alarm signals and the metadata. By way of example, a speed value having 10 different values from 0 to 9 meters per second might be converted to a speed value of 1, 2 or 3 corresponding to speeds in different speed ranges, e.g. slow speeds wherein speed is 0 $ms^{-1}$, 1 $ms^{-1}$, 2 $ms^{-1}$ take a value of 1, medium speeds 3 $ms^{-1}$, 4 $ms^{-1}$, 5 $ms^{-1}$, 6 $ms^{-1}$, 7 $ms^{-1}$ take a value of 2, and fast speeds 8 $ms^{-1}$, 9 $ms^{-1}$ take a value of 3. This would reduce the size of the required lookup table to 30% its former size. To give an alternative example one of the detectors outputs may be multiplied by a metadata value to reduce the dimension of the lookup table.

It is understood that the analysis module 205 and information modules may be embodied in a separate unit remote from the detectors 101, 102 or contained within one of the detectors 101, 102. Moreover the analysis module, information module, and other modules described herein, may be hardware devices or may be embodied in software running on a suitable data processing system.

Metadata 207 from the VMD 101, or metadata 208 from the PIR detector 102, or a combination of both is used to communicate when conditions in the field of view 103 of the VMD 101 are poor and will lead to poor or unreliable VMD detection performance and the weighting applied to the PIR detector signal, $\omega_{IR}$, is increased relative to $\omega_V$. This increases detection performance when VMD conditions are poor. Examples of poor VMD conditions include, but are not limited to, poor lighting, fog, smoke, moving foliage, moving shadows, and a physical obscuration on or near at least one detector such as insects, spiders, dirt or plant foliage.

In an alternative embodiment, either metadata 207 from the VMD system, or metadata 208 from the PIR detector, or a combination of both is used to communicate when conditions are poor for PIR detection in the field of view 104 and to increase the weighting applied to the VMD signal, $\omega_V$, relative to $\omega_{IR}$. This increases detection performance when PIR conditions are poor (adverse conditions). Examples of poor PIR conditions include fog, heavy rain and high ambient temperatures. It is understood that increasing the weighting factor, $\omega_V$ relative to the weighting factor applied to the PIR, $\omega_{IR}$, can be achieved by decreasing the weighting factor $\omega_{IR}$.

In some embodiments, the VMD 301 receives at least one of PIR metadata 208 and VMD metadata 207 and the PIR detector 302 receives at least one of VMD metadata 207 and PIR metadata 208. In these embodiments, the detection outputs 203, 204 depend on the information received from at least one of the PIR metadata 208 and VMD metadata 207. In these embodiments, the analysis module produces a combined alarm signal depending on the detection outputs but plays no part in weighting the signals. In a preferred embodiment, the detection outputs 203, 204 are weighted by weighting factors $\omega_V$, and $\omega_{IR}$ and the detectors respond to metadata indicating adverse conditions in the same way as discussed above.

Figure 3:
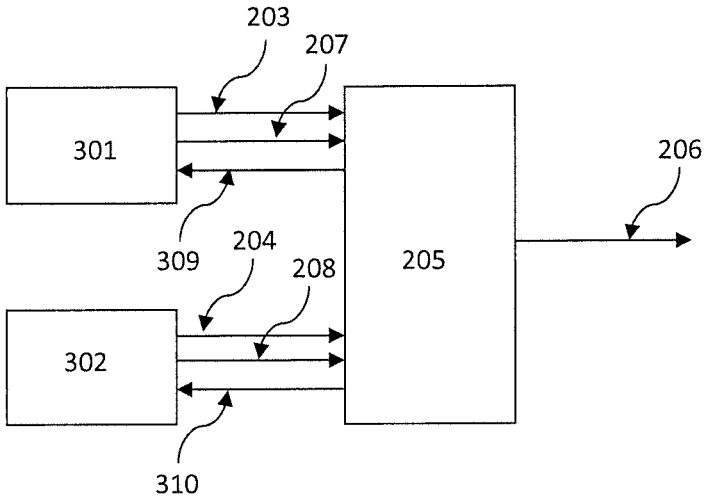
FIG. 3 shows a block diagram of an intrusion detection system according to another embodiment of the invention.

Referring to the embodiment shown in FIG. 3, the internal operation of PIR detector 302 is influenced by control data 310 generated by analysis module 205, which may include, but is not limited to, a threshold at which the alarm signal 204 is generated. Similarly, the internal operation of VMD detector 301 is influenced by control data 309 which may include, but is not limited to, the threshold at which alarm signal 203 may be generated. Analysis module 205 makes use of the alarm signals 203 and 204, and the metadata 207 and 208 to generate control signals 309 and 310, and combined alarm signal 206.

In a preferred embodiment, two intelligent PIR sensors (not shown) are used in the PIR detector 302 (FIG. 3). The PIR sensors are used facing each other with at least partially overlapping fields of view. In normal operation, the PIR sensors operate in double-ended mode ('double-knock') and detection from both PIR sensors are required to raise an alarm from the PIR detector 302. VMD 301 also views the scene and its field of view overlaps that of the two PIR sensors. If the VMD detects sufficient fog or other obscuration this will be encoded in the VMD metadata 207. As shown in FIG. 3, the analysis module 205 then sends a control signal 310 the PIR detector 302 to operate in single-ended mode where only one sensor needs to detect a target to raise an alarm for the PIR detector 302. Since factors such as fog and heavy rain reduce the effective sensing range of PIR detectors, this active monitoring and switching system ensures that detection is still possible even if one PIR sensor cannot see the target due to obscuration. It is understood that more than two PIR sensors can be used. The VMD metadata 207 may also be used by the analysis module 205 to change the weighting factor in the weighted sum of alarm signals 203, 204.

In another embodiment, the VMD metadata 207 is sent directly to PIR detector 302 rather than to an analysis module. The PIR detector 302 contains a processor that receives the VMD metadata and switches to single-ended mode if the VMD metadata 207 represents—or encodes information indicating—adverse conditions affecting the PIR detectors. The analysis module may operate to require detection signals indicating target detection from both the VMD and PIR detector before producing a combined alarm signal 206.

In a preferred embodiment, an indication that there has been tampering with the VMD (video tamper detection information) is encoded in the metadata 207. If the analysis module 205 receives an indication of video tampering, it is programmed to only require detection from the PIR detector 302 to output an alarm signal 206.

In another preferred embodiment, an indication that there has been tampering with the PIR detector is encoded in the metadata 208. If the analysis module 205 receives an indication of tampering, it is programmed to only require detection from the VMD 301 to output an alarm signal 206. The analysis module 205 may also be configured to respond accordingly to either tampering with the VMD 301 or the PIR detector 302. As will be appreciated the tamper metadata can be derived from a sensor associated with a detector, e.g. an accelerometer, vibration sensor, open cover sensor or the like, or from the detector itself, e.g. my analysing scene movement in images in a video stream.

In one embodiment, the detection output signals 203, 204 are constantly supplied to the analysis module 205 and the signals 203, 204 change when a target is detected. This provides a means for detecting if there is a fault or if the detectors have been tampered with by reacting to the situation where there is a loss of signal. For example, the system could be configured to send the combined alarm signal on loss of signal from any detector. Alternatively, the system could be configured to switch to single ended detection to not require a detection output signal from the detector that the analysis module is not receiving an output signal from. Not requiring an output signal from a detector can be achieved by setting the weighting factor for that detector to zero.

In a yet another embodiment, the fog detection or video tamper detection is combined with day/night information. This can assist in differentiating between loss of light at twilight or night-time and loss of visibility due to fog. For example, loss or reduction of light at twilight or night time may not be considered an adverse condition requiring a change to single-ended mode of operation.

In another preferred embodiment of the intrusion detection system, the PIR detector 102, 302 includes two intelligent PIR sensors that each have an LED or other emitter that can be detected by the opposing PIR sensor or another suitable receiver. The PIR detector 102, 302 normally operates in a dual-ended, or double-knock, mode where both sensors must detect a target in order to raise an alarm by sending a PIR alarm signal 204 from the PIR detector 102, 302. However, if the fog is sufficiently thick that a PIR sensor or its receiver cannot detect the opposing PIR sensor's emitter, then the PIR detector switches to single-ended mode, where only one sensor needs to detect a target to raise an alarm 204 from the PIR detector 102, 302. This ensures that detection is still possible even if one PIR cannot see the target due to fog. Ideally the LED brightness is modulated by a signature that the opposing PIR sensor or its receiver can detect and verify. This reduces the effect of any spurious light interfering with the receiver and leading to erroneous determination of the detection conditions.

Additionally, if there are adverse conditions that affect the PIR detectors, the analysis module 205 may only require an alarm signal from the VMD to trigger an alarm signal 206 to be output.

Position Information

Reflectors and/or lenses can be used to focus a specific detection area, or a line of sensitivity (sometimes called a virtual curtain), in the scene onto the PIR sensor or sensors. Using reflectors and/or lenses, multiple curtains can be mapped onto one pair of sensors so that if an intruder crosses any one of the virtual curtains the one pair of sensors can be used to detect it. Reflectors and/or lenses can be used to gather more IR radiation than a sensor alone would collect, thereby increasing its sensitivity. Furthermore, if a detector is mounted above the ground, then reflectors and/or lenses can be used to map zones at different distances (range zones) onto the one pair of sensors. This can be achieved by using different angles of declination of the reflectors and/or lenses. By suitable combinations of optics it is possible to design PIR detectors to suit different needs. Two examples from Xtralis® ASIM® include a wide angle detector capable of monitoring a region 40 m wide by 40 m deep, and a long-range detector capable of monitoring several narrow zones giving coverage from 10 m to 150 m.

In one embodiment, the PIR detector is used to determine the position of a target within the field of view 104 of PIR detector. The target position of the potential intruder determined from the PIR sensor (e.g. which range zone or which position) is compared to the positions of targets being tracked in the VMD system. If a match is found, then an alarm may be generated with more confidence. This could be achieved by sending a control signal 309 to the VMD to adjust any combination of VMD settings to increase its sensitivity and/or adjusting any combination of PIR settings to increase its sensitivity. In this way, the sensitivity of the system may be increased.

In another preferred embodiment, if a match is found in the target position by the analysis module 205, then and only then is a double-knock alarm permitted when both the VMD 301 and the PIR detector 102 both also meet their independent alarm criteria. In this way, the risk of false alarms from unrelated events is reduced.

The target position could be determined from the relative signal strength from a pair of PIR sensors with overlapping fields of view, or the position determined from the combination of range zone signals from two opposing PIR sensors, or the proximity to virtual curtains. Additionally, multiple PIR sensors with different fields of view 104 corresponding to different zones could be used. The VMD image is aligned such that the VMD field of view 103 preferably overlaps and contains the PIR detector field of view 104.

Target position information from the PIR detector 102 is determined from its frame of reference. Target position information from the VMD 101 is determined from its frame of reference. The frame of reference is a 2D area which is projection of the relevant field of view 103, 104. In order for the position information from the detectors to be relevant to each other, the correspondence between the two frames of reference must be established. Since the PIR 102 and VMD 101 are typically separate devices, and the alignment of the devices is approximate, the correspondence between the two frames is not implicit. The correspondence can be established by creating a mapping between one frame of reference and the other as follows. A source of radiation can be moved around the VMD field of view 103, and for each position, the location in the VMD frame of reference, and the corresponding PIR signals in the PIR frame of reference can be noted. If sufficient samples are taken across the full extent of the VMD field of view, then a map of PIR values can be produced that are intrinsically aligned with the VMD field of view. If the VMD 101 detects movement at a certain location in the VMD frame of reference, then the mapping can determine where this should appear in the PIR frame of reference. If the PIR detector 102 does not detect movement in that area, then a false alarm can be eliminated.

In a variation, the alignment could be performed as follows. The distance at furthest point to be detected is measured from the VMD camera 101 and PIR detector 102. An operator could then walk across the field of view at that distance until the PIR 104 detects a maximum signal. A mobile app could be used to display the PIR signal to assist the operator. An object with a known dimension, e.g. a stick of known height, could be placed in the ground at that point. An operator can then highlight the stick in the analytics window and record its height. The detection cone of the PIR in VMD coordinates can be computed by using the PIR's known characteristics and aligning its axis with the video image of the stick in the ground.

In another variation, the PIR and VMD share the same optical path so as to ensure that both detection systems have the same field of view 106. The VMD and PIR algorithms shall be adapted to suit the optics. In one implementation, the VMD sensor is a thermal imaging sensor, and the PIR functionality is emulated in software using PIR functions operating on signals derived from a combination of the image sensing pixels. In a second implementation, the radiation from the optical path is split into a thermal component that is directed to the PIR, and a visible component that is directed to the VMD image sensor.

In a third variation, the PIR and VMD are part of the same physical unit and are aligned at the factory such as that described in U.S. Pat. No. 5,936,666.

Speed and Direction Information

The nature of the change in the signal of a single PIR sensor, or the combination of changes in the signals from multiple sensors, can be used to estimate the speed of travel and the size of the target, and these can be used to discriminate between targets to reduce false alarm rates.

In one embodiment, the rate of change of the position of the target from the PIR detector (i.e. the speed of movement) is compared to the speeds of targets being tracked in an aligned image in the VMD system by the analysis module 205. If a match is found, then the combined alarm 206 may be generated with more confidence. This could be achieved by adjusting any VMD settings by sending the control signal 309 to the VMD to increase the sensitivity of the system and/or by sending a control signal 310 to the PIR to increase the sensitivity of the system. Alternatively it may be achieved by removing the need for the analysis module to require double-knock on the detection signals since the "double-knock" has already been satisfied by requiring matching speeds determined by different detectors. The lower level non-alarm detection signals can be adjusted to reflect the fact that matching speeds were determined.

In a preferred embodiment, both the position and speed information from the PIR detector 302 are compared to the location and speed of targets being tracked in an aligned image in the VMD 301. The system 100 can be configured to send a combined alarm signal 206 if either position or speed match. Alternatively, the system can be configured to require both position and speed to match to reduce the likelihood of false alarms.

In another alternative embodiment, directional information about an intruding target's movement from a suitably equipped PIR detector 302 is compared to the direction of targets being tracked in an aligned image in the VMD 301 by the analysis module 205. If a match is found, then the combined alarm 206 may be generated with more confidence.

In another embodiment, information 307 from the VMD 301 is used to adjust parameters in the PIR detector 302. In one implementation of this, the PIR detector 302 sensitivity is increased by sending a control signal 310 to the PIR detector if the VMD 301 detects a distant target or a slow moving target and/or a small target, or it could be reduced if it detects a nearby target or a fast moving target and/or a large target. In this way the PIR sensitivity is better matched to the target range and speed and improves detection reliability.

Signal Strength Information

In another alternative embodiment, the amplitude of the PIR signal 204 is compared to the size of targets being tracked in an aligned image in the VMD 101, 301. If the PIR signal amplitude corresponds with a similarly sized target tracked in the VMD 101, 301, then an alarm 206 may be generated with more confidence.

In yet another embodiment, a strong VMD detection output signal 203 causes the combined system 100 to increase the PIR detection sensitivity. A strong signal may have a large amplitude and indicates that the detection is more reliable than a weak signal. The strength of the signal is determined from within the VMD which analyses target parameters such as contrast, speed, location and size. If the PIR detector 302 then indicates the presence of a target, the combined system may then generate an alarm 206. This increases the sensitivity of the system to targets that the PIR detector is less sensitive to.

Alternatively, a strong PIR detection output signal 204 causes the system to increase the VMD detection sensitivity. A strong signal may have a large amplitude and indicates that the detection is more reliable than a weak signal. The strength of the signal is determined by the PIR detector which analyses parameters such as sensor amplitude, rate of change, ambient temperature. If the VMD 301 also indicates the presence of a target, then the combined system may then generate an alarm. This increases the sensitivity of the system to targets that the VMD is less sensitive to.

In an alternative embodiment, a strong PIR signal 204 causes the combined system to increase the VMD sensitivity only in the locations corresponding to where the PIR signal originated from. If the VMD 301 then indicates the presence of a target the combined system may then generate an alarm 206. This increases the sensitivity of the system to targets that the VMD is less sensitive to by cross-referencing with a location where the PIR detector has indicated a possible target.

In an optional embodiment, the PIR signal 204 and/or metadata 208, is used to direct a pan-tilt-zoom camera to zoom in on the locality of the detection, and to direct the VMD system to analyse the video from this camera. By localising the VMD 101, 301 to the area where a target is likely to be, the sensitivity of the VMD system is increased and therefore increases the sensitivity of the combined system. The metadata 208 accordingly contains information relating to the position of the target detected by the PIR detector 102, 302.

In some embodiments, the raw data from the PIR detector 102, 302 may be stored alongside the raw video data. This allows synchronised and bit-exact playback of the PIR and video signals so that the effects of improvements to analysis algorithms involving both signals can be observed. This can be used in improve the sensitivity of the combined system and used to reduce the susceptibility to false alarms. The raw data from the PIR and the video may be time-stamped so that they can be retrieved later and resynchronised with each other. The time-stamped data may be recorded at the PIR and only retrieved if needed to analyse a potential alarm event. This can reduce the bandwidth required to communicate with the PIR detector.

In some embodiments, the PIR signal 204 may be temperature compensated at the PIR detector 102, 302 so that the alarm signal can be computed at the sensor. Alternatively, the ambient temperature may be determined independently, either at the sensor or remotely from it, and used in conjunction with an uncompensated PIR signal to determine the PIR alarm conditions remotely from the sensor.

It will be understood that the invention disclosed and defined in this specification extends to all alternative combinations of two or more of the individual features mentioned or evident from the text or drawings. All of these different combinations constitute various alternative aspects of the invention.

It will also be understood that the term signal in this specification may refer to a multi-dimensional signal. The alarm signals and metadata may therefore be encoded or multiplexed within the same physical signal.

The invention claimed is:

1. An intrusion detection system comprising:

at least two detectors, wherein each detector is configured to produce a detection output;

processors;

a memory storing instructions that, when executed by at least one processor among the processors, cause the intrusion detection system to perform operations comprising, at least:

producing metadata including information relating to adverse conditions that reduce detection performance of one or more of the at least two detectors; and generating a combined alarm signal, wherein the combined alarm signal is a function of a plurality of detection outputs from the at least two detectors and the metadata.

2. The intrusion detection system according to claim 1, wherein the function, for generating the combined alarm signal, is chosen to favor an output from one or more detectors whose performance is least affected by an adverse condition.

3. The intrusion detection system according to claim 2, wherein the function is a weighted sum of detection outputs from the at least two detectors and the weighted sum depends on weighting factors corresponding to each of the at least two detectors.

4. The intrusion detection system according to claim 3, wherein the weighting factors depend on the metadata.

5. The intrusion detection system according to claim 3, wherein the metadata is received by the at least two detectors which apply the weighting factors to the detection outputs to produce weighted detection outputs; and wherein the operations further comprise receiving the weighted detection outputs and determining the combined alarm signal.

6. The intrusion detection system according claim 1, wherein the function is embodied as a table of combined alarm signal values indexed by at least one vector corresponding to the plurality of detection outputs from the at least two detectors and comprising values from a first plurality of possible values of the plurality of detection outputs and at least one value corresponding to the metadata.

7. The intrusion detection system according to claim 6, wherein a smaller vector is computed having at least one combined value corresponding to a combination of one or more of the plurality of detection outputs and/or at least one value corresponding to the metadata to index a smaller table of alarm signal values.

8. The intrusion detection system according to claim 1, wherein at least one of the detectors is a video motion detector (VMD) and at least one of the detectors is a passive infra-red (PIR) detector.

9. An intrusion detection system including:

at least two detectors wherein each detector is configured to produce detection outputs, one detector is a passive infra-red (PIR) detector, wherein the PIR detector includes at least two PIR sensors;

wherein the system is configured such that:

in non-adverse conditions each of the at least two PIR sensors must detect a target in order for the PIR detector to output a PIR alarm signal; and in adverse conditions that affect PIR detection performance, the PIR alarm signal is output, if any one of the at least two PIR sensors detects the target.

10. The intrusion detection system according to claim 9, wherein at least one of the detectors is a video motion detector (VMD) that has a field of view that at least partially overlaps the fields of view of the at least two PIR sensors.

11. The intrusion detection system according to claim 10, wherein the VMD is configured to output metadata relating to the adverse conditions when the adverse conditions that affect PIR detection performance are detected.

12. The intrusion detection system according to claim 11, wherein the metadata output from the VMD is received and processed by an analyzer.

13. The intrusion detection system according to claim 12 wherein the analyzer is further configured to send a control signal to the PIR detector when the adverse conditions that affect the PIR detection performance are detected by the VMD.

14. The intrusion detection system according to claim 13, wherein the PIR detector is configured to receive the control signal and, when the control signal is received from the analyzer, output the PIR alarm signal if any one of the at least two PIR sensors detects the target.

15. The intrusion detection system according to claim 10, wherein the VMD is configured to detect whether there has been a VMD tampering event, and if the VMD tampering event occurs, the VMD is configured to output metadata that includes an indication of the tampering event.

16. The intrusion detection system according to claim 15, wherein when an analyzer receives metadata indicating VMD tampering the analyzer sends the control signal to the PIR detector to configure the PIR detector to require each of the at least two PIR sensors to detect the target in order for the PIR detector to output the PIR alarm signal.

17. The intrusion detection system according to claim 9, wherein the at least two PIR sensors form corresponding pairs, wherein at least one PIR sensor from each pair includes at least one emitter producing emissions that can be detected by the other PIR sensor or another suitable receiver.

18. The intrusion detection system according to claim 17, wherein the system is configured such that a reduced intensity or non-detection of emissions by the other PIR sensor or the another suitable receiver is taken to be an adverse condition.

19. An intrusion detection system, the system including at least one video motion detector (VMD) and at least one passive infrared (PIR) detector, each detector being configured to output a detection output to an analyzer when the respective detector detects an intrusion event; wherein the at least one PIR detector is used to determine a parameter of an intruding target; and the at least one VMD independently determines a parameter of at least one target in a field of view of the VMD;

wherein if the parameter determined by the at least one PIR detector substantially matches the parameter of the at least one target independently determined by the VMD, then the analyzer is configured to send a control signal to the VMD and/or PIR detector such that the VMD and/or PIR detector sensitivity is increased when the control signal from the analyzer is received.

20. The intrusion detection system according to claim 17, wherein if the parameter determined by the at least one PIR sensor substantially matches the parameter of the at least one target independently determined by the VMD, then the analyzer is configured to produce an alarm signal.

21. The intrusion detection system according to claim 17, wherein the parameter determined by the at least PIR sensor and the parameter independently determined by VMD include any one or more of the parameters selected from the group of position, speed, size or direction.

22. The intrusion detection system according to claim 17, wherein the analyzer is configured to send the control signal to the PIR detector to increase PIR detection sensitivity when a strong VMD signal is received by the analyzer; and if the intrusion event is detected by the PIR detector, then the analyzer produces an alarm signal.

23. The intrusion detection system according to claim 17, wherein the analyzer module is configured to send the control signal to the VMD to increase VMD detection sensitivity when a strong PIR detection signal is received by the analyzer; and if the intrusion event is detected by the VMD, then the analyzer produces an alarm signal.

24. The intrusion detection system according to claim 23, wherein the VMD detection sensitivity is only increased in locations corresponding to locations where the strong PIR detection signal is received.

25. The intrusion detection system according to claim 23, wherein:

the strong PIR detection signal is an uncompensated signal so that alarm conditions can be determined remotely from the sensor; and an ambient temperature is determined independently of the PIR signal and used in conjunction with the uncompensated PIR signal to determine the alarm conditions.

* * * * *